US007713320B2

(12) United States Patent
Pham

(10) Patent No.: US 7,713,320 B2
(45) Date of Patent: May 11, 2010

(54) EVACUABLE BAG HAVING FILTER FOR REDUCING PARTICULATE CONTAMINATION OF VACUUM VALVE

(75) Inventor: Linh Pham, Chula Vista, CA (US)

(73) Assignee: Illinois Tool Works Inc., Glenview, IL (US)

( * ) Notice: Subject to any disclaimer, the term of this patent is extended or adjusted under 35 U.S.C. 154(b) by 431 days.

(21) Appl. No.: 11/648,318

(22) Filed: Dec. 29, 2006

(65) Prior Publication Data

US 2008/0156685 A1 Jul. 3, 2008

(51) Int. Cl.
*B01D 46/02* (2006.01)

(52) U.S. Cl. ..... 55/385.4; 55/364; 55/367; 55/369; 383/61.3; 383/97; 383/100; 383/103

(58) Field of Classification Search ..... 55/385.4, 55/364, 376, 486, DIG. 39, DIG. 2, 367, 55/369, 377, 379, 372; 15/352, 353; 493/186, 493/214; 251/262; 604/332, 333; 383/61.3, 383/97, 100–103
See application file for complete search history.

(56) References Cited

U.S. PATENT DOCUMENTS 3,755,993 A * 9/1973 Cote ..... 55/370
3,971,643 A * 7/1976 Hufton ..... 55/372
4,451,258 A * 5/1984 Jensen ..... 604/333
4,940,461 A * 7/1990 Steer ..... 604/333
5,370,638 A * 12/1994 Keyes ..... 604/333
5,626,569 A * 5/1997 Holtermann et al. ..... 604/333
5,725,645 A * 3/1998 Wickland et al. ..... 96/17
6,007,594 A * 12/1999 Kaczor ..... 55/367
6,355,078 B1 * 3/2002 Wickland ..... 55/385.4
6,408,872 B1 6/2002 Skeens et al.
6,468,332 B2 * 10/2002 Goglio et al. ..... 96/134
6,575,191 B2 6/2003 Skeens et al.
6,786,947 B2 * 9/2004 Mountford ..... 55/367
6,802,879 B2 * 10/2004 Scanlon ..... 55/367
6,837,268 B2 1/2005 Skeens et al.
2003/0126843 A1 * 7/2003 Hsu ..... 55/385.4

* cited by examiner

*Primary Examiner*—Duane Smith
*Assistant Examiner*—Minh-Chau T Pham
(74) *Attorney, Agent, or Firm*—Ostrager Chong Flaherty & Broitman P.C.

(57) ABSTRACT

An evacuable, reclosable bag including a receptacle having an interior volume and a mouth; a closure operable to open and close the mouth; a one-way valve penetrating a wall of the receptacle; and a filter attached to the same receptacle wall. The filter is arranged so that any air flowing from the interior volume outward through the one-way valve must flow through the filter before flowing through the valve. The filter may be a mesh or fabric (woven or nonwoven) having openings sized to prevent the passage of particulate matter placed inside the bag.

19 Claims, 6 Drawing Sheets

EVACUABLE BAG HAVING FILTER FOR REDUCING PARTICULATE CONTAMINATION OF VACUUM VALVE

TECHNICAL FIELD

This disclosure generally relates to collapsible, evacuable, reclosable containers, such as pouches, bags or other packages.

BACKGROUND

Collapsible, evacuable storage containers typically include a flexible, airtight bag, an opening through which an article or matter is inserted inside the bag, a zipper for closing the opening and hermetically sealing the bag, and a fixture (e.g., a one-way valve assembly) through which excess air is evacuated from the bag. A user places an article or matter into the bag through the opening, seals the opening, and then evacuates air from the interior volume of the bag through the fixture. With the bag thus evacuated, a compressible article or compressible matter contained therein may be significantly compressed so that it is easier to transport and requires substantially less storage space.

Collapsible, evacuable storage containers are beneficial for reasons in addition to those associated with compression of the stored article or matter. For example, removal of the air from the storage container inhibits the growth of destructive organisms, such as moths, silverfish, and bacteria, which require oxygen to survive and propagate. Moreover, such containers, being impervious to moisture, inhibit the growth of mildew.

Not only large, compressible items such as clothing may be stored in a collapsible, evacuable storage container. For example, it may be desirable to store bulk items made of small particles, such as powders or granulated resins, in an evacuated container. One situation that commonly occurs is that a particular bulk item is shipped in a large, rigid container such as a drum. Bulk items may be moisture sensitive and are sealed against moisture during shipment. But many times a user does not need to use the entire contents of the large container, and so once exposed to air the remaining bulk contents quickly become unusable and are thus wasted.

Alternatively, vacuum bags can be used to compress and store manufacturing waste, such as a combination of polymeric particles and water. The air inside the bag and most of the water can be extracted through a one-way valve to effectively reduce the waste volume during shipment to a disposal site. In one case, the valve mechanism comprises a flexible flap that contacts a lip area. Since small particles tend to travel with the airflow generated by the vacuum, some of the polymeric particles can lodge around the lip area of the valve mechanism, thus preventing the vacuum flap from sealing completely, thereby causing air leakage into the evacuated bag.

There is a need for a vacuum storage bag that has means for preventing small particles contained within the bag from entering and interfering with proper operation of the valve mechanism.

SUMMARY

This disclosure relates to an evacuable, reclosable storage bag suitable for containing particulate matter. The bag comprises: a receptacle having an interior volume and a mouth; a closure operable to open and close the mouth; a one-way valve penetrating a wall of the receptacle; and a filter attached to the same receptacle wall. The filter is arranged so that any air flowing from the interior volume outward through the one-way valve must flow through the filter before flowing through the valve. The filter may be a mesh or fabric (woven or nonwoven) having openings sized to prevent the passage of particulate matter placed inside the bag.

One aspect is an evacuable, reclosable bag comprising: a receptacle having an interior volume and a mouth; a closure operable to open and close the mouth of the receptacle; a one-way valve penetrating the receptacle; and a filter attached to the receptacle and arranged so that any air flowing from the interior volume outward through the one-way valve must flow through the filter before flowing through the valve.

Another aspect is an evacuable, reclosable bag comprising: a receptacle comprising first and second panels and having a mouth, an interior volume of the receptacle being accessible from an exterior volume when the mouth is in an open state; a flexible closure located near the mouth and comprising first and second closure strips respectively joined or connected to the first and second panels, the first and second closure strips comprising respective closure profiles that are mutual engageable to form a substantially airtight seal; a one-way valve assembly penetrating the first panel; and a filter attached to the first panel and arranged so that any air flowing from the interior volume outward through the one-way valve assembly must flow through the filter before flowing through the valve.

A further aspect is an evacuable, reclosable bag comprising: a receptacle having an interior volume and a mouth; a flexible closure disposed across the mouth of the receptacle; a one-way valve penetrating a wall of the receptacle; and a filter attached to a first zone on an inner surface of the wall of the receptacle, the first zone surrounding a second zone on the inner surface of the wall, wherein the valve penetrates the wall in the second zone.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION

Figure 1:
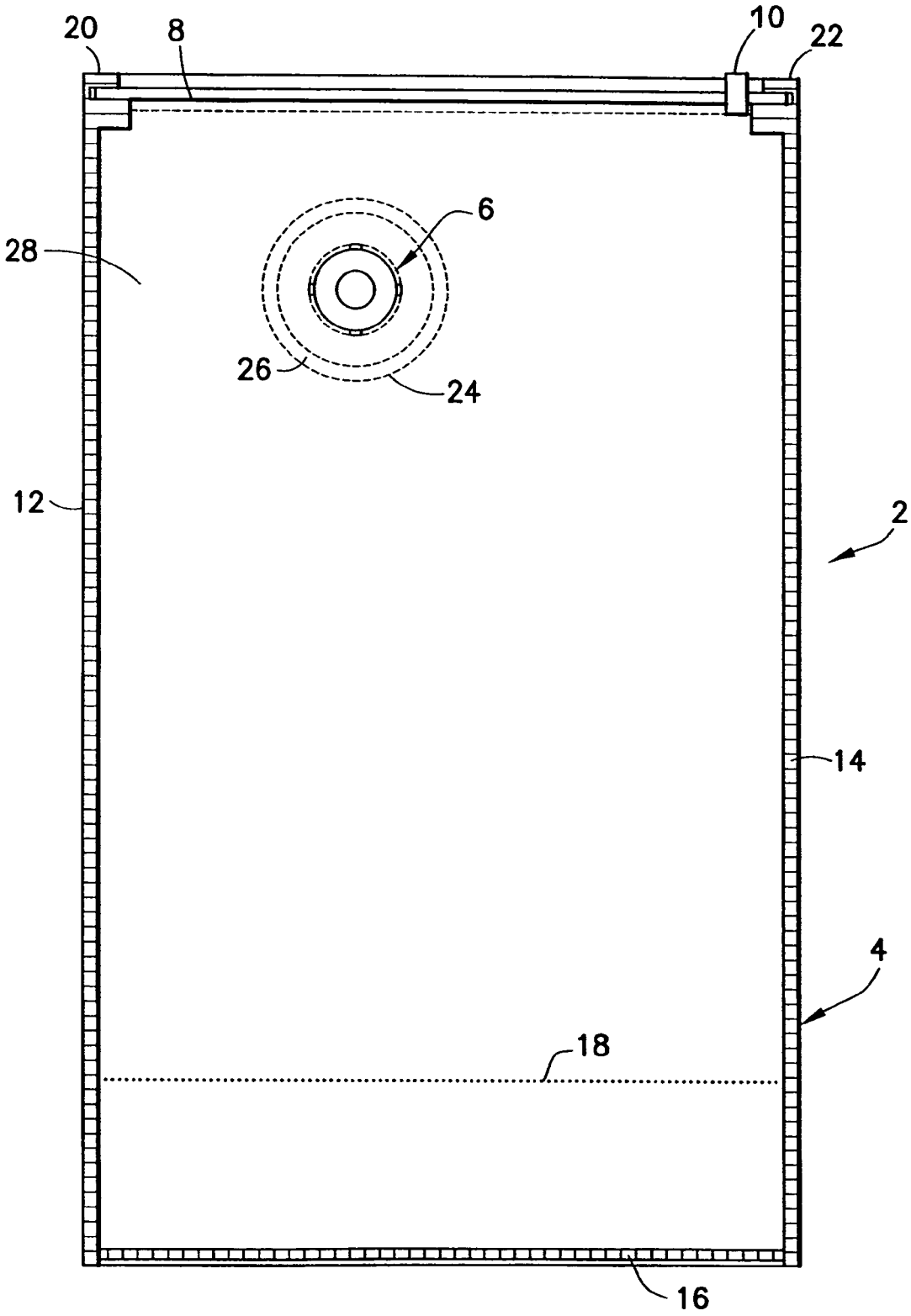
FIG. 1 is a drawing showing a front elevational view of a collapsible, evacuable, reclosable storage bag in accordance with one embodiment of the invention.

FIG. 1 shows a collapsible, evacuable, reclosable storage bag 2 suitable for containing particulate matter. The bag 2 comprises: a collapsible receptacle 4 made of film material and having an interior volume and a mouth; a flexible closure in the form of a plastic zipper 8 operable to open and close the mouth; a one-way vacuum valve assembly 6 penetrating a wall 28 of the receptacle 4; and a filter 24 attached to the interior surface of same receptacle wall 28. The filter 24 is arranged directly over the vacuum valve assembly 6 in a manner such that any air flowing from the interior volume outward through the one-way valve 6 must flow through the filter before flowing through the valve. By attaching a filter on the receptacle wall, directly over the vacuum valve, small particles that might otherwise contaminate the airtight seal in the valve can be filtered out of the air exiting the bag during evacuation.

Figure 2:
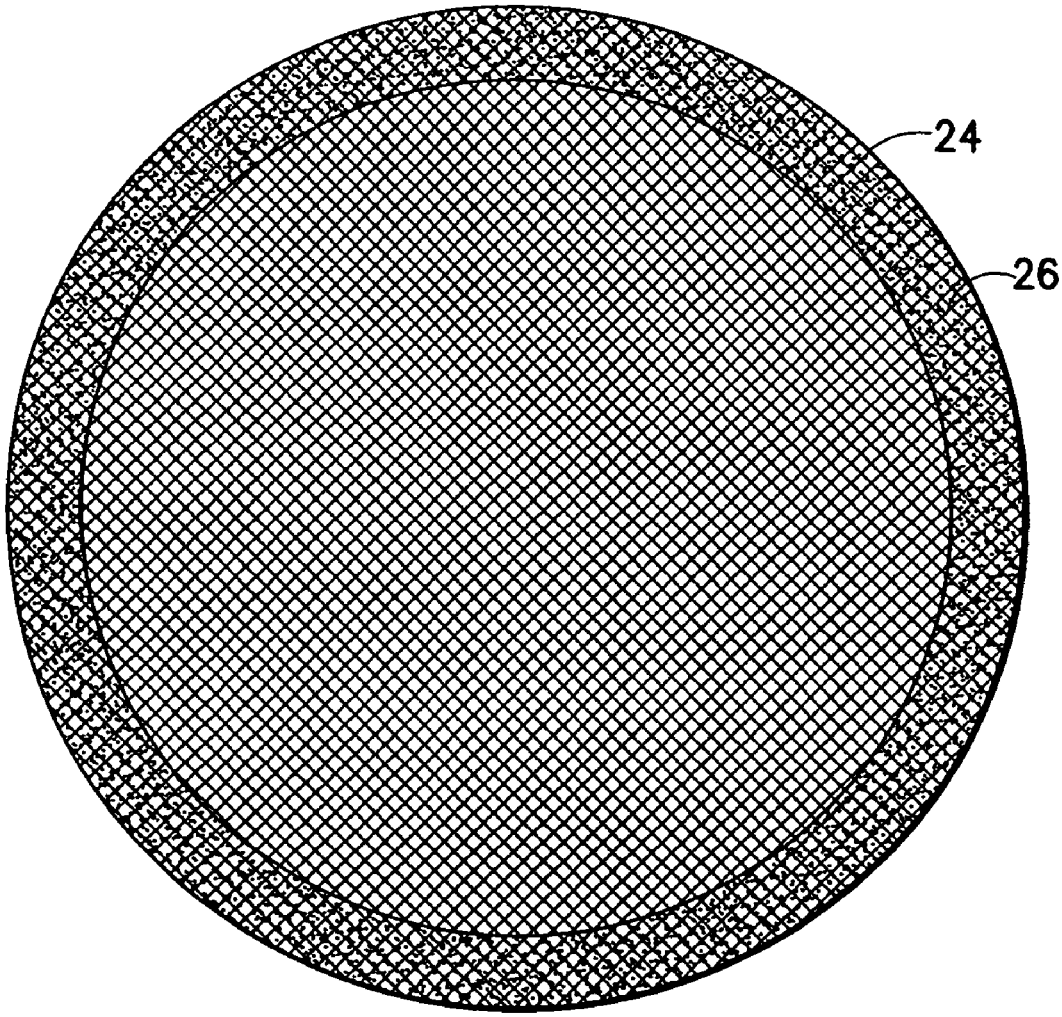
FIG. 2 is a schematic representation of a filter of a type suitable for incorporation in a storage bag of the type depicted in FIG. 1.

The filter 24 may be a mesh (e.g., a screen or woven fabric with an open texture) or nonwoven fabric with an open texture. The openings should be sized to prevent the passage therethrough of particulate matter placed inside the bag. In one implementation, the filter 24 is made of spunbond polypropylene. An exemplary filter is depicted in FIG. 2. In this example, the filter 24 is circular and carries an annular band of adhesive material 26. Prior to assembly of the bag, the adhesive band may be covered with a release liner (not shown). To install the filter, the release liner is peeled off, thereby exposing the adhesive, which is then pressed against the interior surface of the receptacle wall 28, adhering thereto.

As seen in FIG. 1, the inner diameter of the annular band of adhesive material 26 is greater than the outer diameter of the one-way valve assembly 6. The circular filter 24 may be arranged so that it is concentric with the one-way valve assembly 6. Alternatively, the filter have other geometric shapes, such as square, rectangular, elliptical, pentagonal, hexagonal, and so forth. Whatever shape is used, a perimetral portion of the filter be adhered to the interior surface of the receptacle wall that is penetrated by the valve assembly, which perimetral portion should surround the valve assembly. This ensures that any air flowing out through the valve must first pass through the filter. The filter will then act as a screen, preventing any particles that will not fit through the openings in the filter from passing through. The size of the openings can be varied as a function of the size of the particles contained in the storage bag.

In accordance with one storage bag specifically designed to contain polycarbonate particulate waste produced during the edging of polycarbonate eyeglass lenses, the filter has a thickness of 0.9 mm, while the openings in the filter have a maximum dimension of 0.2 mm. The adhesive for this specific implementation is about 0.12 mm. Adhesive #9832 from 3M or other suitable adhesive may be used. The adhesive liner (not shown) should be designed to be easily removed for assembly. For other applications, the filter specifications can differ from the foregoing.

The zipper 8 shown in FIG. 1 may comprise a pair of mutually interlockable extruded plastic strips that are joined to each other at opposing ends thereof. The one-way valve assembly 6 can be used to evacuate an interior volume bounded by the receptacle 4 and the zipper 8 when the latter is closed. Although not shown in FIG. 1, the conventional valve assembly 6 also typically comprises a cap that can be snapped onto a portion of the valve assembly that is disposed external to receptacle 4. The cap must be removed before the receptacle can be evacuated, and then is replaced after the receptacle has been evacuated. The cap is intended to seal the valve assembly to prevent air from entering the evacuated receptacle.

The receptacle 4 depicted in FIG. 1 comprises a front wall or panel 28, a rear wall or panel (behind the front wall), and a bottom gusset. The panels and gusset may be made of thermoplastic film. The receptacle may be constructed of a blended extrusion layer of polyethylene sandwiched between a nylon layer and a layer of polyethylene sheeting. However, the materials comprising the receptacle may be altered so as to prevent interaction with the contents stored therein. The fold of the gusset is indicated by dashed line 18 in FIG. 1. The front and rear walls or panels are joined together at side seams 12 and 14 by conduction heat sealing to form a receptacle having an interior volume. The side edges of the gusset are captured in the side seams 12 and 14. The bottom edges of the gusset are joined to the front and rear walls or panels by bottom seams, only one of which (item 16) is shown in FIG. 1. In addition, a pair of end seals 20 and 22 (discussed in more detail later) are formed at the ends of the bag mouth. The zipper is installed in or near the bag mouth. Alternatively, the receptacle may be made from a web of film that is folded to form the bottom gusset prior to formation of the side seals. The front wall 28 of receptacle 4 has an aperture (not shown in FIG. 1) in which to install the valve assembly 6.

A gusseted bag is shown for the purpose of illustration only. The invention also has application in vacuum storage bags that do not have gussets, for example, a bag having a receptacle comprising front and rear walls or panels joined (e.g., by heat sealing) along three sides by two side seams and a bottom seam.

During use, particulate matter (not shown) may be placed inside the receptacle 4 while the zipper 8 is open, i.e., while the closure profiles of the interlockable zipper strips are disengaged from each other. After the particulate matter to be stored has been placed inside the receptacle, the mouth of the receptacle 4 can be sealed by pressing the closure strips together to cause their respective closure profiles to interlock with each other. Although the closure profiles may have many different designs, the design must be one that ensures that an airtight seal can be formed at the mouth of the receptacle.

The zipper strips can be pressed together using a device 10 commonly referred to as a "slider" or "clip", which straddles the zipper. The typical slider has a generally U-shaped profile, with respective walls or disposed on opposing sides of the zipper. A gap between the slider sidewalls is small enough that the zipper can pass through that gap only if the zipper is in a closed state. Thus when the slider is moved along an open zipper, this has the effect of pressing the incoming sections of the zipper strips together. The zipper is opened by pulling apart the zipper upper flanges, as explained in more detail below. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

The zipper 8 is designed to form a hermetic seal at the mouth of the receptacle 4 when the zipper 8 closed. After the zipper has been closed, the interior volume of the receptacle can be evacuated by sucking air out via the one-way valve assembly 6. Air can be drawn out of receptacle 4 through valve assembly 6 using a conventional vacuum source (not shown in FIG. 1), such as a household or industrial vacuum cleaner. The valve assembly 6 (e.g., when capped) and the zipper 8 maintain the vacuum inside receptacle 4 after the vacuum source is removed.

The front and rear panels of the receptacle 4 are respectively sealed to the zipper strips by lengthwise conduction heat sealing in conventional manner. Alternatively, the interlockable zipper strips can be attached to the front and rear panels by adhesive or bonding strips or the closure profiles can be extruded integrally with the web material. The walls of the receptacle may be formed of various types of gas-impermeable thermoplastic web material. The preferred gas-impermeable thermoplastics are nylon, polyester, polyvinyl dichloride and ethylene vinyl alcohol. The web material may be either transparent or opaque.

In many reclosable bags, the zipper comprises a pair of mutually interlockable zipper strips, each zipper strip having a respective generally constant profile along the interlockable portion of the zipper. Each zipper strip further comprises upper and lower flanges that extend from the respective closure profile in opposite directions. Each flange is a thin web of the same material used to make the closure profiles. The upper flanges serve as pull flanges that can be gripped and pulled apart to open the zipper. Typically, the ends of the zipper strips are joined together (e.g., by thermal crushing or ultrasonic welding) at the sides of the bag.

The filter described above may be employed in conjunction with vacuum valves of different constructions. The present invention is not directed to any particular valve construction. For the sake of illustration, however, a suitable valve for use in various embodiments will now be described with reference to FIGS. 3 and 4.

Figure 3:
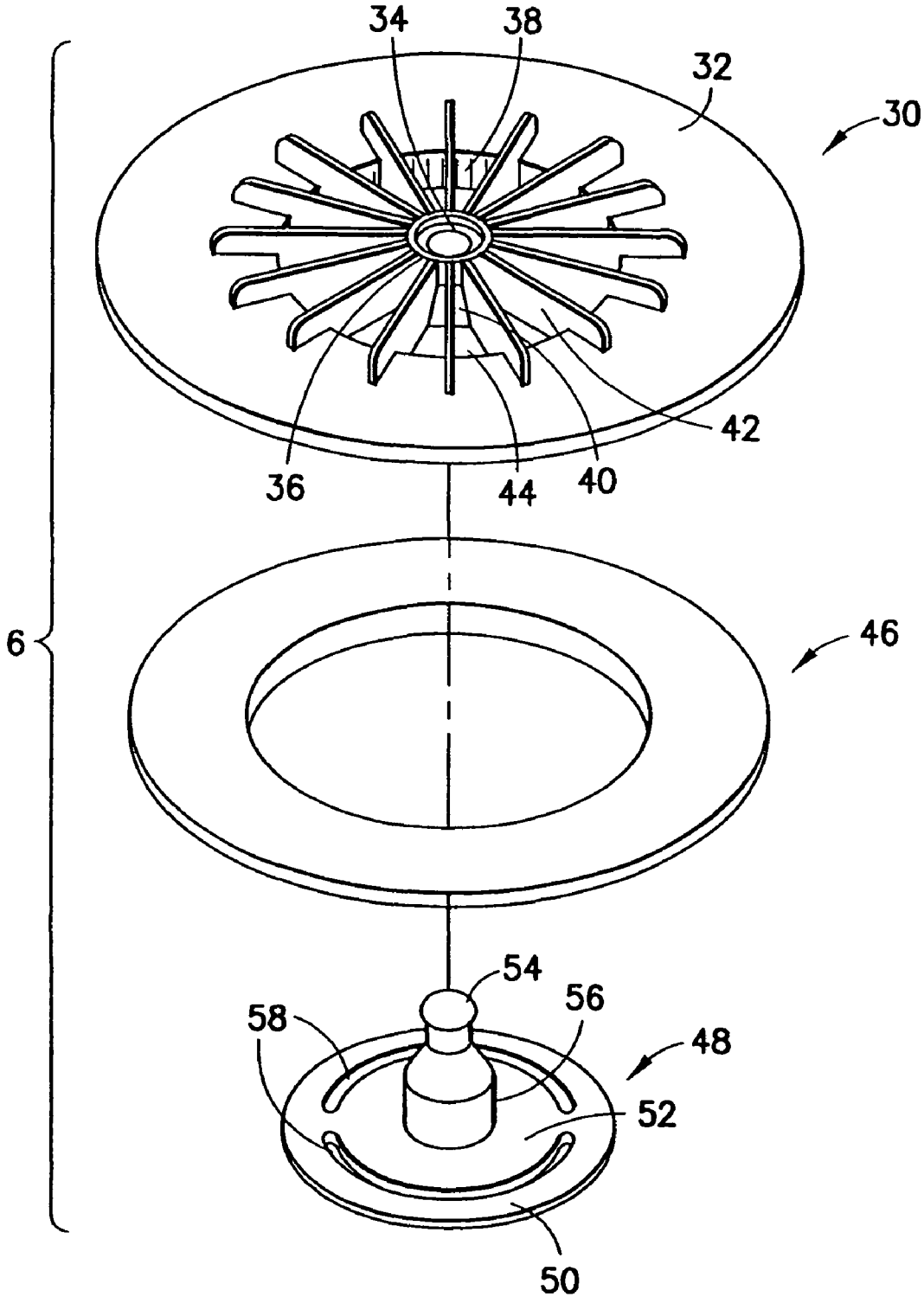
FIG.3 PRIOR ART
FIG. 3 is a drawing showing an exploded isometric view of a known valve assembly suitable for use with a storage bag of the type depicted in FIG. 1.

FIG. 3 is an exploded isometric view showing a conventional valve assembly 6. The valve assembly 6 comprises a base 30, a retaining ring 46, and a valve element 48. The valve assembly 6 is mounted to the receptacle 4 (see FIG. 1) such that a flange 32 of base 30 is on the inside of the bag. Base 30 extends through the hole in the bag and is held in place by welding the base flange 32 to the bag material to provide the seal. The retaining ring 46 is placed over the base 30 on the outside of the bag to cover the weld area.

The valve element 48 provides the one-way airflow feature in valve assembly 6. The valve element 48 may be made of clear polyvinylchloride. Valve element 48 has an outer annular portion 50 and an inner diaphragm 52. The annulus 50 and diaphragm 52 are connected by respective neck or bridge portions, but are otherwise separated by a pair of arc-shaped slots or gaps 58. The annular portion 50 functions as a face against which a vacuum source, such as a conventional household or industrial vacuum cleaner nozzle (not shown), may be sealed as the nozzle is pressed against the base 30. When the nozzle is in place and a vacuum device or source draws air through the nozzle, the diaphragm 52 flexes open and air inside the bag passes through a plurality of holes 40 in base 30 and into the vacuum nozzle. When the nozzle is removed, the diaphragm 52 returns to its original shape and seals against the base 30, thus preventing air from passing back into the bag through holes 40 in the base. The seal is further enhanced by the positive air pressure on the external surface 52.

Figure 4:
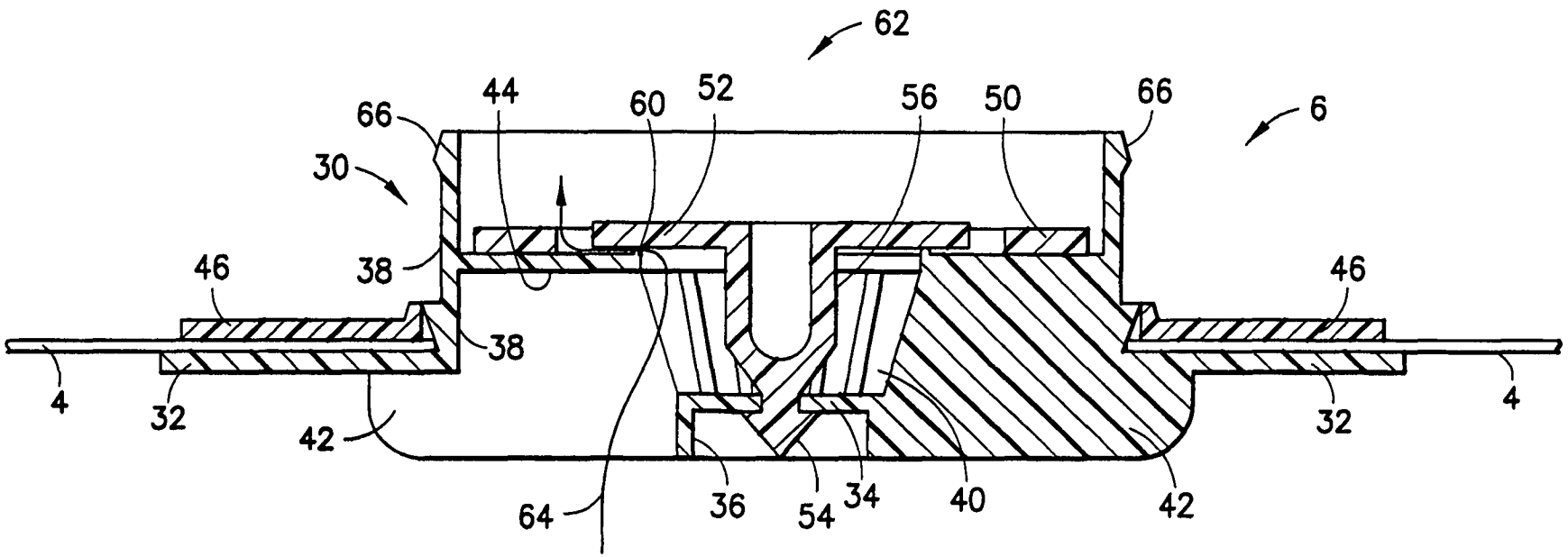
FIG. 4 PRIOR ART
FIG. 4 is a drawing showing a cross-sectional view of the valve assembly depicted in FIG. 3 attached to a storage bag of the type depicted in FIG. 1 (the cap of the valve assembly is removed).

As shown in FIG. 3, a plurality of radial vanes 42 separate holes 40. Vanes 42 radiate outward from a circular inner sidewall 36 that supports an annular seat 34. The annular valve element seat 34 surrounds an opening through which the head 54 at the end of the stem 56 of the valve element 48 is passed, as best seen in FIG. 4. FIG. 4 is a cross-sectional view of the assembled valve assembly 6, the section plane being parallel to and intersecting the central axis depicted in FIG. 3. The annular seat 34 is a ring having an outer diameter greater than the outer diameter of the head 54 and having an inner diameter less than the outer diameter of the head 54. The valve element 48 is made of an elastic material, so that the head 54 compresses as it passes through the opening in the annular seat 34 and then expands on the other side, in which state the undersurface of the head rests on and is supported by the seat 34.

Still referring to FIG. 4, the base 30 further comprises a circular outer sidewall 18 that supports another annular valve element seat 44. The annular seat 44 is a ring having an outer diameter greater than the outer diameter of the outer annular portion 30 of the valve element 28 and having an inner diameter greater than the maximum diameter of the stem 62. The outer annular portion 30 of the valve element 28 sits on the seat 44, while the diaphragm 32 sits on a circular bead 66 that projects above the plane of the surface of seat 44 at the edge of a circular opening 68 provided in the base 30.

It would be undesirable if, during evacuation, particles from the bag interior were to become lodged between the lip of annular seat 44 and the valve flap or diaphragm 52 (e.g., in the vicinity of bead 60), thereby preventing the valve flap or diaphragm 52 from sealing completely (and causing an air leak). A filter of the type disclosed herein could be incorporated in a vacuum storage bag that had a valve of the type shown in FIGS. 3 and 4. The maximum size of the openings in the filter should be sufficiently small that only particles too small to cause air leakage through the vacuum valve can pass through.

In FIG. 3, the valve base 30 is shown inserted through a flexible receptacle 4 held in place by an annular retaining ring 46. A vacuum source (not shown) can be placed with the terminus of its nozzle pressed against the outer annular portion 50 to draw air through the valve. The suction applied by the vacuum nozzle causes the diaphragm 52 to flex. The opening 62 is in fluid communication with the multiplicity of holes 40 when any portion of the diaphragm 30 is lifted off of the bead 66. The flow of air out of the bag during suction is indicated by the arrow 64 in FIG. 4. During lifting of the diaphragm 52, the head 54 is latched behind the seat 34, thereby preventing the valve element from popping out of the base 30. When the vacuum source nozzle is removed, diaphragm 52 returns to its position sealed against bead 60 so as to prevent air from flowing in a reverse direction through the valve.

It is known to place a removable cap (not shown in FIG. 4) over the opening 62 to protect inner portions of the valve assembly 6. After the vacuum source has been removed, the cap can be snapped onto the end of the sidewall 38, which has an outer peripheral bead 66. The cap has a sidewall with an inner peripheral bead that is pushed past the bead 66. The cap will be held on by frictional forces as well as by the resistance presented by the bead 66 to removal of the cap. It is known to provide a central post (not shown) inside the cap that presses the central portion of the diaphragm (at the base of the stem 56 shown in FIG. 3) downward when the cap is pushed onto the base sidewall 38. This design is intended to exert a pressure that maintains the diaphragm 52 in contact with the bead 60 on the seat 44.

To maintain a vacuum inside the storage bag, the zipper in a closed state must provide a hermetic seal at the mouth of the bag. Many different types of zippers can be used. The present invention is not directed to any particular zipper construction. For the sake of illustration, however, a suitable zipper for use in various embodiments will now be described with reference to FIG. 5.

Figure 5:
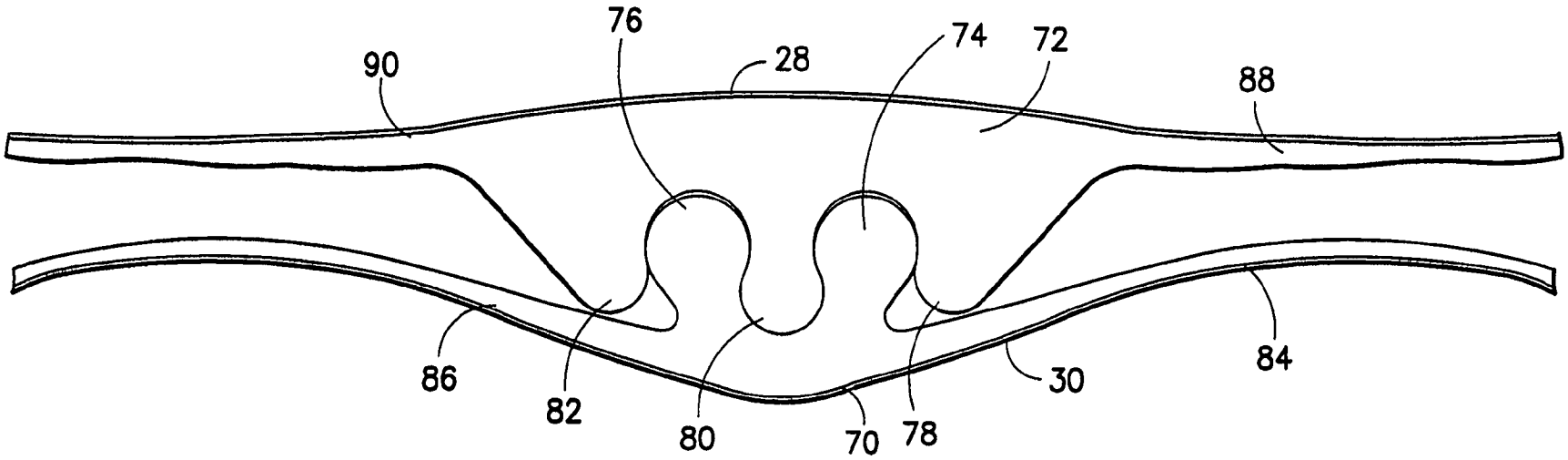
FIG.5 PRIOR ART
FIG. 5 is a drawing showing a cross-sectional view of a known zipper suitable for incorporation in a storage bag of the type depicted in FIG. 1.

FIG. 5 shows a conventional zipper 8 that comprises a pair of mutually interlockable extruded zipper strips 34 and 36. The zipper strip 34 comprises a pair of projections 38 and 40 having ball-shaped closure profiles, an upper flange 48, and a lower flange 50. The zipper strip 36 comprises a trio of projections 42, 44 and 46 (only projection 44 has a ball-shaped closure profile), an upper flange 52, and a lower flange 54. For each zipper strip, the portions exclusive of the projections will be referred to herein as a "base". The bag walls may be joined to the respective bases of the zipper strips by conduction heat sealing across their entire height or across only portions thereof. For example, the bag walls could be joined to the zipper lower flanges and to the upper flanges by means of conduction heat sealing.

Still referring to FIG. 5, the projections 38 and 40 interlock with projections 42, 44 and 46 by fitting inside the respective spaces therebetween. The upper flanges 48 and 52 can be gripped by the user and pulled apart to open the closed zipper. The opened zipper can be reclosed by pressing the zipper strips together (e.g., using a slider) along the entire length of the zipper with sufficient force to cause the projections 38 and 40 to enter the respective spaces between the projections 42, 44 and 46. Typically, such a slider takes the form of a U-shaped clip that fits over the zipper with clearance for the upper flanges, while the legs of the clip cam the zipper profiles of the incoming zipper section into engagement when the slider is moved along the zipper in either direction. The opposing ends of the zipper strips 34 and 36 are typically fused together in the regions of the bag side seals, as previously described.

To ensure that a reclosable bag of the type shown in FIG. 1, having a containment zipper of the type shown in FIG. 5, has the capability to seal against vacuum, the zipper ends must be hermetically sealed. To achieve this goal, the method disclosed in U.S. patent application Ser. No. 11/257,849, filed on Oct. 25, 2006 and entitled "Reclosable Packages for Vacuum, Pressure and/or Liquid Containment," could be utilized.

As previously noted, a slider or clip may be provided for closing the zipper. Many different types of sliders can be used. The present invention is not directed to any particular slider construction. For the sake of illustration, however, a suitable slider for use with various embodiments will now be described with reference to FIG. 6.

Figure 6:
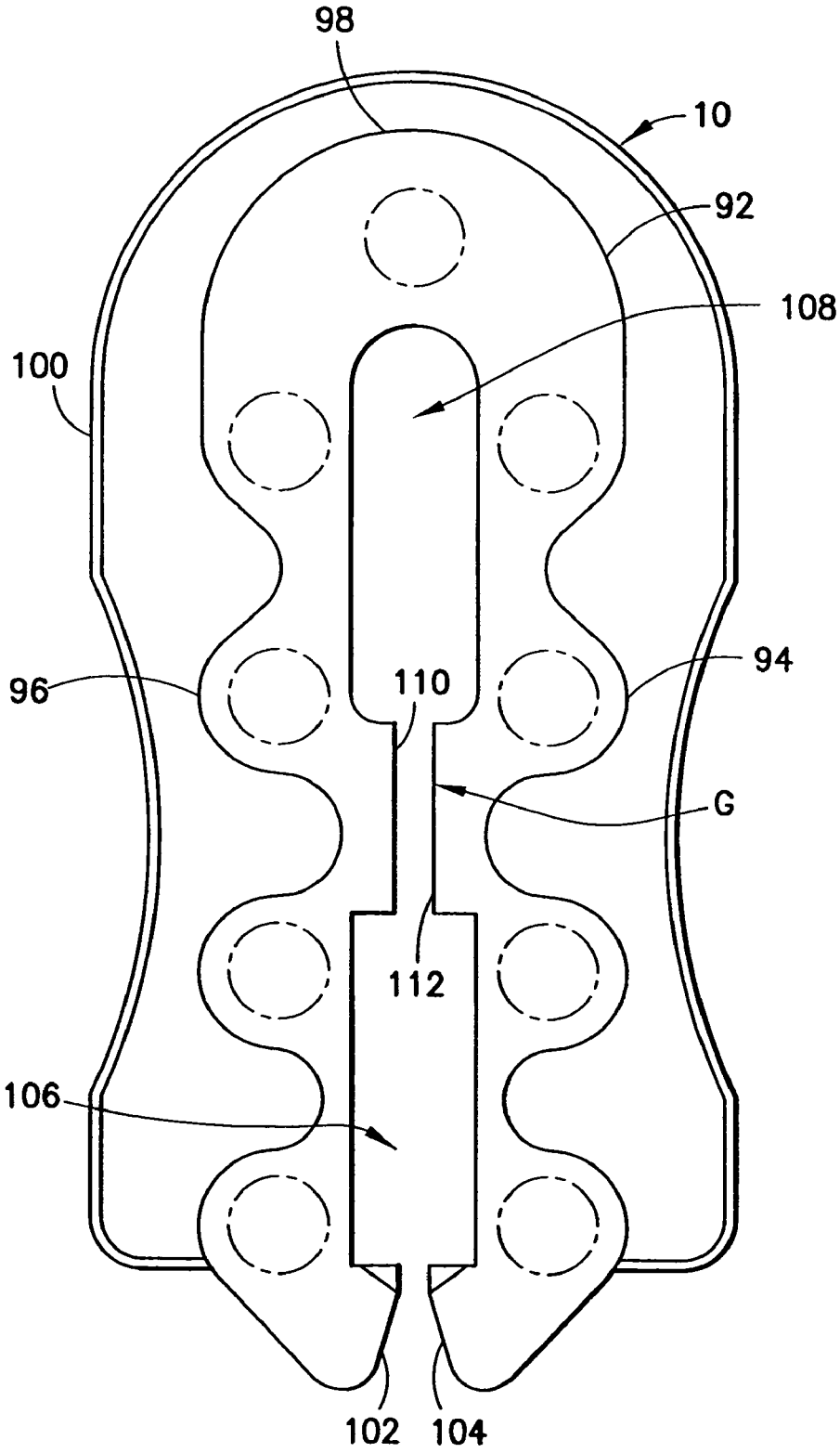
FIG.6 PRIOR ART
FIG. 6 is a drawing showing an end view of a known slider suitable for use with a storage bag of the type depicted in FIG. 1.

FIG. 6 shows an end view of a slider in accordance with one embodiment. The slider 20 is generally U-shaped and comprises mutually opposing sidewalls 94 and 96, a bridge 98 connecting the sidewalls 94 and 96, and a generally U-shaped stiffening rib 100 projecting outward from the sidewalls 94 and 96 and the bridge 98. The sidewalls 94, 96 are separated by a gap G of varying width. The slider further comprises mirror-image angled projections 102 and 104 projecting from respective distal portions of sidewalls 94 and 96. These hook-shaped angled projections (hereinafter "hooks") retain the slider on the zipper. The retaining hooks 102 and 104 have mutually opposing angled surfaces that form an included angle at an entry point into the gap G. The small (less than 45 degrees) entry point angle reduces the amount of force needed to insert the slider onto the zipper and minimizes any potential damage to the slider profile. Preferably the slider is made by injection molding, so that the stiffening rib is integral with the sidewalls and bridge. On each side of the stiffening rib 100, the sidewalls and bridge form a generally clip-shaped structure having undulating external surfaces. The undulations in the sidewalls facilitate manufacture by injection molding. The stiffening rib does not have an undulating surface, but has ergonomically designed curved depressions on opposite sides thereof. The curvature is designed to generally match the shape of a finger or thumb tip, making it more comfortable for the bag user and also improving the bag user's grasp of the slider.

Still referring to FIG. 6, the slider gap narrows in width at confronting generally parallel planar surfaces 110 and 112 of respective opposing plateaus. Below the plateaus, opposing grooves define a lower chamber 106 having a generally rectangular profile. During slider insertion, the zipper and upper marginal portions of the bag panels enter the gap G, with the zipper closure profiles (not shown in FIG. 6) residing in the lower chamber 106 of that gap. The lower flange of one zipper strip extends below the bottom of the slider, while the upper flanges (of both zipper strips extend through the narrow section of the gap (between the opposing plateaus) and into the upper chamber 108 of gap G.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

The invention claimed is:

1. An evacuable, reclosable bag comprising:

a receptacle having an interior volume and a mouth, said receptacle comprising first and second walls;

a zipper operable to open and close said mouth of said receptacle, said zipper comprising first and second mutually interengageable strips respectively joined to said first and second walls of said receptacle, said first and second strips in a mutually interengaged state forming an airtight seal;

a one-way valve penetrating said first wall of said receptacle, said one-way valve having an open state and a closed state; and a filter attached to an interior surface of said first wall of said receptacle and arranged so that any air flowing from said interior volume outward through said one-way valve must flow through said filter before flowing through said valve, wherein said interior volume of said receptacle can be evacuated via said one-way valve in its open state when said first and second strips are in said mutually interengaged state and remain evacuated after said one-way valve is restored to its closed state.

2. The bag as recited in claim 1, wherein said filter has a periphery affixed to said interior surface of said first wall of said receptacle, said filter periphery surrounding a peripheral portion of said valve.

3. The bag as recited in claim 2, wherein said filter periphery is affixed to said interior surface of said first wall of said receptacle by adhesive material.

4. The bag as recited in claim 1, wherein said filter comprises a mesh.

5. The bag as recited in claim 1, wherein said filter comprises fabric.

6. The bag as recited in claim 5, wherein said fabric is spunbond polypropylene.

7. The bag as recited in claim 1, further comprising particulate matter in said interior volume of said receptacle.

8. The bag as recited in claim 7, wherein said particulate matter has a particle size such that said particulate matter cannot pass through said filter.

9. An evacuable, reclosable bag comprising:

a receptacle comprising first and second panels and having a mouth, an interior volume of said receptacle being accessible from an exterior volume when said mouth is in an open state;

a flexible closure located near said mouth and comprising first and second closure strips respectively joined or connected to said first and second panels, said first and second closure strips comprising respective closure profiles that are mutual engageable to form an airtight seal;

a one-way valve assembly penetrating said first panel, said one-way valve having an open state and a closed state; and a filter attached to an interior surface of said first panel and arranged so that any air flowing from said interior volume outward through said one-way valve assembly must flow through said filter before flowing through said valve, wherein said interior volume of said receptacle can be evacuated via said one-way valve in its open state when said respective closure profiles are in a mutually engaged state and remain evacuated after said one-way valve is restored to its closed state.

10. The bag as recited in claim 9, wherein said filter has a periphery affixed to said interior surface of said first panel, said filter periphery surrounding a peripheral portion of said valve assembly.

11. The bag as recited in claim 10, wherein said filter periphery is affixed to said interior surface of said first panel by adhesive material.

12. The bag as recited in claim 9, wherein said filter comprises a mesh.

13. The bag as recited in claim 9, wherein said filter comprises fabric.

14. The bag as recited in claim 13, wherein said fabric is spunbond polypropylene.

15. The bag as recited in claim 9, further comprising particulate matter in said interior volume of said receptacle, wherein said particulate matter has a particle size such that said particulate matter cannot pass through said filter.

16. An evacuable, reclosable bag comprising:

a receptacle having an interior volume and a mouth;

a flexible closure disposed across said mouth of said receptacle, said closure having an open state and a closed state, said closure in its closed state forming an airtight seal;

a one-way valve that passes through a hole in a wall of said receptacle, said one-way valve having an open state and a closed state; and a filter attached to a first zone on an inner surface of said wall of said receptacle, said first zone surrounding a second zone on said inner surface of said wall, wherein said valve penetrates said wall in said second zone and in its closed state prevents ambient air from entering said receptacle via said hole, and said interior volume of said receptacle can be evacuated via said one-way valve in its open state when said closure is in its closed state and remain evacuated after said one-way valve is restored to its closed state.

17. The bag as recited in claim 16, wherein said filter comprises fabric having a periphery that is adhered to said first zone.

18. The bag as recited in claim 17, further comprising particulate matter in said interior volume of said receptacle, wherein said particulate matter has a particle size such that said particulate matter cannot pass through said fabric.

19. The bag as recited in claim 16, wherein said filter comprises a mesh having a periphery that is adhered to said first zone.

* * * * *